US007300488B2

(12) United States Patent
Szabo et al.

(10) Patent No.: US 7,300,488 B2
(45) Date of Patent: Nov. 27, 2007

(54) POWDER METAL COMPOSITION AND METHOD FOR PRODUCING COMPONENTS THEREOF

(75) Inventors: Christophe Szabo, Ratingen (DE); Owe Mårs, Höganäs (SE)

(73) Assignee: Höganäs ab, Höganäs (SE)

( * ) Notice: Subject to any disclaimer, the term of this patent is extended or adjusted under 35 U.S.C. 154(b) by 191 days.

(21) Appl. No.: 10/801,647

(22) Filed: Mar. 17, 2004

(65) Prior Publication Data

US 2004/0234407 A1 Nov. 25, 2004

Related U.S. Application Data

(60) Provisional application No. 60/482,866, filed on Jun. 27, 2003.

(30) Foreign Application Priority Data

Mar. 27, 2003 (SE) ..... 0300881

(51) Int. Cl.
*B22F 1/00* (2006.01)
*B22F 3/14* (2006.01)

(52) U.S. Cl. ..... 75/252; 419/11; 419/36; 419/38; 419/60

(58) Field of Classification Search ..... 75/255, 75/252; 419/11, 36, 38, 60
See application file for complete search history.

(56) References Cited

U.S. PATENT DOCUMENTS 2,807,542 A * 9/1957 Frank ..... 419/54
2,961,312 A * 11/1960 Elbaum ..... 420/436
3,410,732 A 11/1968 Smith et al.
3,648,343 A 3/1972 Haller et al.
3,846,126 A * 11/1974 Foley et al. ..... 419/23
3,888,663 A 6/1975 Reichman
4,089,682 A * 5/1978 Saito et al. ..... 75/236
4,123,266 A * 10/1978 Foley et al. ..... 75/244
4,129,444 A 12/1978 Dreyer et al.
4,464,206 A * 8/1984 Kumar et al. ..... 75/246
4,668,290 A 5/1987 Wang et al.
4,818,482 A * 4/1989 Poole et al. ..... 419/33
4,913,737 A * 4/1990 Nakamura et al. ..... 408/204
5,002,731 A 3/1991 Crook et al.
5,462,575 A 10/1995 Del Corso
6,348,081 B1 2/2002 Horata et al.
2004/0237712 A1 * 12/2004 Whitaker et al. ..... 75/231

* cited by examiner

*Primary Examiner*—Roy King
*Assistant Examiner*—Ngoclan T. Mai
(74) *Attorney, Agent, or Firm*—Buchanan Ingersoll & Rooney PC

(57) ABSTRACT

The present invention concerns a powder metal composition for producing powder metal components comprising a Co-based pre-alloyed powder, with irregularly shaped particles comprising at least 15% by weight Cr and less than 0.3% by weight C, admixed with graphite.

The invention also concerns a method for producing PM components by pressing of articles to shape from the powder metal composition according to the invention and sintering them.

18 Claims, No Drawings

POWDER METAL COMPOSITION AND METHOD FOR PRODUCING COMPONENTS THEREOF

The benefit is claimed under 35 U.S.C. § 119(a)-(d) of Swedish Application No. 0300881-0 filed Mar. 27, 2003, and under 35 U.S.C. § 119(e) of U.S. Provisional Application No. 60/482,866 filed Jun. 27, 2003.

FIELD OF THE INVENTION

The present invention concerns powder metallurgy. More specifically the present invention concerns a cobalt-based powder metal composition and a method for producing components thereof, especially for heavy duty applications.

BACKGROUND OF THE INVENTION

Cobalt-based alloys, such as Stellite® (Trade Mark for Co—Cr—W alloys) are hard alloys that are extremely resistant to many forms of wear. Products of these alloys show high hardness over a wide temperature range and are resistant towards corrosion. These products are used for inter alia casting of various kinds of components such as machine parts (bearing shells, valve seat inserts etc) or other components where high density, high strength and wear resistance are required.

Cast material often suffers from micro structural defects and carbide segregation. Carbide segregation leads to inhomogenously distributed hard phases. Disadvantages with such materials are lack of fracture toughness and poor machinability.

Powder metallurgy (PM) products generally possess a more homogenous microstructure than cast products. Further advantages with the PM production method are that costly machining into final shape may be excluded or minimized in comparison with traditional casting methods and that the method is more suitable for producing large quantities of small articles.

Attempts have been made over the years to produce cobalt-based products using the PM technology. Thus U.S. Pat. No. 4,129,444 discloses a process wherein atomised Co-based alloy powders are coated with a binder and then consolidated to produce discrete bodies that are dried, crushed and screened to obtain agglomerates. The agglomerates are pressed into green compacts which are sintered at high temperature. Furthermore the U.S. Pat. No. 5,462,575 discloses a powder metallurgy component prepared of a gas atomised Co—Cr—Mo alloy powder. The alloy powder is filled in a canister and baked in vacuum to degas the powder and the powder filled canister is thereafter consolidated, preferably by hot isostatic pressing (HIP).

OBJECTS OF THE INVENTION

An object of the invention is to provide a new Co-based powder metal composition which can be used in conventional PM processes.

Another object is to provide a Co-based powder metal composition with high compactibility which can be compacted to high green density and high green strength.

Still another object is to provide a green body of a cobalt based alloy which can be machined before sintering.

A further object is to provide a powder metal composition which can be compacted and sintered to high density without high sintering temperatures.

SUMMARY OF THE INVENTION

These objects, as well as other objects that will be apparent from the description below, have now been obtained according to the present invention by providing a new Co-based powder metal composition. Critical features of this composition are that the composition comprises a Co-based pre-alloyed powder with irregularly shaped particles admixed with graphite. Furthermore, the Co-based pre-alloyed powder should include less than 0.3% by weight of carbon and at least 15% by weight Cr. The Co-based pre-alloyed powder preferably comprises at least 30% by weight and preferably less than 80% by weight Co.

The invention also concerns a method comprising the steps of providing a powder metal composition according to the invention and compacting the composition in a die at a pressure of at least 400 MPa to a component of desired shape.

DETAILED DESCRIPTION OF THE INVENTION

The Co-based pre-alloyed powder in the composition according to the invention may be produced by subjecting a melt having the desired composition to atomising by water.

The Co-based pre-alloyed powder according to the invention comprises less than 0.3% by weight carbon. The carbon content of the powder is however preferably less than 0.1% by weight, and most preferably less than 0.05% by weight (i.e. essentially free from C except for inevitable impurities).

The Co-based pre-alloyed powder comprises at least 15% by weight and preferably less than 35% by weight Cr.

The addition of Cr improves the strength of the Cobalt matrix by solution hardening and/or carbide formation. These effects are further improved by the addition of W and/or Mo.

Other elements which may be included in the Co-based pre-alloyed powder may be chosen from Ni, Fe, Si, Mn, V and B.

A preferred pre-alloyed powder according to the invention comprises: 15-35% by weight Cr, 0-20% by weight W, 0-25% by weight Ni, 0-5% by weight Si, 0-5% by weight Fe, 0-10% by weight Mo, balance Co and less than 0.3% by weight C.

Another preferred powder according to the invention further comprise 0-3% by weight Mn, 0-4% by weight V and 0-4% by weight B.

A powder metal composition according to the invention comprises a pre-alloyed powder according to the invention admixed with graphite. The amount of graphite addition depends on the desired content of carbides and on the content of carbide forming elements. The graphite content is preferably at least 0.5% by weight, more preferably at least 0.7% by weight and preferably less than 3% by weight.

The powder metal composition may further comprise one or more additives selected from the group consisting of alloying elements, lubricants, processing aids and binders.

Other elements may be added for improving properties or reducing costs.

The used lubricant plays an important role for the achieved green properties. Good results have been achieved with Kenolube™ (available from Hödganäs AB, Sweden), amide wax, metal stearates and other commonly used lubricants.

The processing aids used in the powder metal composition according to the invention may consist of talc, forsterite, manganese sulphide, sulphur, molybdenum disulphide, boron nitride, tellurium, selenium, barium difluoride and calcium difluoride, which are used either separately or in combination.

The powder metal composition according to the invention is filled in a die and compacted at a pressure of at least 400 MPa to a component of desired shape. This compaction yields a component with high green strength and green density and the component may even be green machined at this stage. This is an advantage as the material in the final sintered component are hard and difficult to machine.

The component is sintered at a temperature of at least 1080° C., preferably in protective atmosphere or vacuum.

The components produced of the powder according to the invention and according to the method of the invention are especially suited for heavy-duty applications, such as valve seat inserts for engines where the valve seats need to last the life time of the engine, without replacement or service.

The following example, which is not intended to be limiting, presents certain embodiments of the present invention.

EXAMPLE

The test mixtures (mix 1-5) listed in Tables 2 and 3 were prepared from the water atomised pre-alloyed powders in Table 1 (% by weight).

TABLE 1

| | Co | Cr | Ni | W | Si | Fe | C |
|---|---|---|---|---|---|---|---|
| 285 | 36.4 | 25.8 | 23.0 | 12.5 | 1.12 | 1.19 | 0.01 |
| 286 | 34.5 | 26.1 | 23.0 | 12.5 | 1.16 | 1.16 | 1.60 |

The pre-alloyed powders were further admixed with lubricants, alloying elements and processing aids according to table 2 and 3. In test mix 1, 3 and 4, 1.7% by weight graphite was further included. TRS-samples, according to ISO 3995, were moulded. The compacting operation was performed with the three different types of samples at 600 and 800 MPa respectively.

The resulting components were tested for green density (GD) and green strength (GS). After sintering at 1120° C. for 30 minutes in a 90% $N_2$/10% $H_2$ atmosphere the components were tested for sintered density (SD) and hardness (Hv10). Tables 4 and 5 disclose the results of the tests.

TABLE 2

| Mix | 1 (% by weight) | 2 (% by weight) |
|---|---|---|
| Powder | Balance Powder 285 | Balance Powder 286 |
| Lubricant | 40 PEO:60 ORG* 0.8 | 40 PEO:60 ORG* 0.8 |
| Graphite (KS 44) | 1.7 | 0 |

*40% Polyethyleneoxide:60% Orgasol

TABLE 3

| Mix | 3 (% by weight) | 4 (% by weight) | 5 (% by weight) |
|---|---|---|---|
| powder | Balance Powder 285 | Balance Powder 285 | Balance Powder 286 |
| Fe (MH 80, 23) | 10 | 10 | 10 |

TABLE 3-continued

| Mix | 3 (% by weight) | 4 (% by weight) | 5 (% by weight) |
|---|---|---|---|
| Cu (325) | 5 | 5 | 5 |
| $MoS_2$ | 1 | 1 | 1 |
| Lubricant | 40 PEO:60 ORG* 0.8 | Kenolube ™ 0.8 | 40 PEO:60 ORG* 0.8 |
| Graphite (KS 44) | 1.7 | 1.7 | 0 |

*40% Polyethyleneoxide:60% Orgasol

TABLE 4

| Mix | 1 | | 2 | |
|---|---|---|---|---|
| Compaction Pressure (MPa) | 600 | 800 | 600 | 800 |
| GD (g/cm$^3$) | 6.70 | 7.00 | 5.73 | BF* |
| GS (MPa) | 13.1 | 19.7 | 1.3 | BF* |

*Bars Fractured on ejection

TABLE 5

| Mix | 3 | | 4 | | 5 | |
|---|---|---|---|---|---|---|
| Compaction Pressure (MPa) | 600 | 800 | 600 | 800 | 600 | 800 |
| GD (g/cm$^3$) | 6.76 | 7.04 | 6.88 | 7.13 | 6.07 | 6.39 |
| GS (MPa) | 15.57 | 21.09 | 10.2 | 13.5 | 2.64 | 4.39 |
| SD (g/cm$^3$) | 6.62 | 6.91 | nm | nm | 6.11 | 6.40 |
| Hv10 | 137 | 175 | nm | nm | 103 | 129 |

nm = not measured

Compaction of mix 2 and to some extent mix 5 did not work, the components exhibited bad surfaces and frequent edge cracks and were too fragile to handle.

Compaction of mix 1, 3 and 4, without C in the pre-alloyed powder, showed a great improvement of the compressibility, as can be seen in Tables 4 and 5, and high green strengths and green densities were achieved for the resulting components. Components with thin walls normally require a green strength of at least 7 MPa to enable handling. Green strengths above 20 MPa normally enable green machining.

The sintered mix 3 components exhibit a higher density and hardness (Hv10) than mix 5 components.

Metallographic studies of the sintered components showed that components made from mix 3 and 5 have similar structures. It is thus possible to create the desired carbide structures in mix 3 components during sintering.

A comparison between mix 3 and mix 4 in Table 5 demonstrates the influence of lubricants on the green strength and green density of the compacted components. Kenolube™ gives a higher density than the mix of polyethyleneoxide and Orgasol which enables better performance in the sintered state.

The invention claimed is:

1. A powder metal composition for compaction when producing powder metal components comprising a Co-based water atomised pre-alloyed powder, with irregularly shaped particles comprising at least 15% by weight Cr, at least one of W and Mo, and less than 0.3% by weight C, the pre-alloyed powder being admixed with graphite.

2. A powder metal composition according to claim 1, further comprising at least one alloying element selected from Ni, Fe, Si, Mn, V and B.

3. A powder metal composition according to claim 1, wherein the content of C in the pre-alloyed powder is less than 0.1% by weight.

4. A powder metal composition according to claim 1, comprising: 15-35% by weight Cr, 0-20% by weight W, 0-25% by weight Ni, 0-5% by weight Si, 0-5% by weight Fe, 0-10% by weight Mo, the balance being Co.

5. A powder metal composition according to claim 1, wherein the content of admixed graphite is at least 0.5% by weight.

6. A composition according to claim 1, further comprising one or more additives selected from the group consisting of lubricants, processing aids alloying elements and binders.

7. A method for producing a component of a Co-based alloy with high green strength and high green density comprising the steps:

a) providing a powder metal composition comprising a Co-based pre-alloyed powder, with irregularly shaped particles comprising at least 15% by weight Cr, at least one of W and Mo, and less than 0.3% by weight C, the pre-alloyed powder being admixed with graphite; and b) compacting the composition in a die at a pressure of at least 400 MPa to a component of desired shape.

8. The method according to claim 7, wherein the pre-alloyed powder contains less than 0.1% by weight C.

9. The method according to claim 7, wherein the content of admixed graphite is at least 0.5% by weight.

10. The method according to claim 7, further comprising the step:

c) sintering the component.

11. The method according to claim 10, wherein the sintering is performed at a temperature of at least 1080° C. in a protective atmosphere or vacuum.

12. A powder metal composition according to claim 2, wherein the content of C in the pre-alloyed powder is less than 0.1% by weight.

13. A powder metal composition according to claim 1, wherein the content of C in the pre-alloyed powder is less than 0.05% by weight.

14. A powder metal composition according to claim 1, wherein the content of the admixed graphite is at least 0.7% by weight.

15. The method according to claim 7, wherein the pre-alloyed powder contains less than 0.05% by weight C.

16. The method according to claim 8, wherein the content of admixed graphite is at least 0.5% by weight.

17. The method according to claim 7, wherein the content of the admixed graphite is at least 0.7% by weight.

18. The method according to claim 8, wherein the content of the admixed graphite is at least 0.7% by weight.

* * * * *